US006567049B1

(12) United States Patent
Huang et al.

(10) Patent No.: US 6,567,049 B1
(45) Date of Patent: May 20, 2003

(54) METHOD FOR MANUFACTURING CHIP ANTENNA BY UTILIZING GENETIC ALGORITHM

(75) Inventors: Chi-Fang Huang, Taipei (TW); Hou-Min Li, Taipei Hsien (TW)

(73) Assignee: King Sound Enterprise Co., Ltd., Kaohsiung (TW)

( * ) Notice: Subject to any disclaimer, the term of this patent is extended or adjusted under 35 U.S.C. 154(b) by 0 days.

(21) Appl. No.: 10/051,097

(22) Filed: Jan. 22, 2002

(51) Int. Cl.[7] ..... H01Q 1/38; H01Q 1/24

(52) U.S. Cl. ..... 343/700 MS; 343/702; 343/895

(58) Field of Search ..... 343/700 MS, 702, 343/895, 873; 29/600; H01Q 1/38, 1/24

(56) References Cited

U.S. PATENT DOCUMENTS 6,342,858 B1 * 1/2002 Dakeya et al. ..... 343/702
6,442,399 B1 * 8/2002 Tsuru et al. ..... 343/702
6,486,853 B2 * 11/2002 Yoshinomoto et al. ..... 343/702

* cited by examiner

*Primary Examiner*—Hoanganh Le
(74) *Attorney, Agent, or Firm*—Bacon & Thomas, PLLC

(57) ABSTRACT

A method for manufacturing chip antenna by utilizing a genetic algorithm to encode possible configurations of a metallic wire attached thereon into a plurality of codes as their chromosomes for mating to produce offspring, and utilizing a simulation tool to evaluate the properties of the chromosomes and find the superior chromosomes corresponding to the configurations of the metallic wire, and utilizing conventional cutting machines to cut a ceramic plate and a metallic film respectively, according to the configurations obtained through the genetic algorithm, to get a substrate and a metallic wire of the appropriate configurations, and then attaching the metallic wire directly to substrate to form a chip antenna having superior physic performances.

13 Claims, 20 Drawing Sheets

METHOD FOR MANUFACTURING CHIP ANTENNA BY UTILIZING GENETIC ALGORITHM

BACKGROUND OF THE INVENTION (1) Field of the Invention

The present invention relates to a method for manufacturing chip antenna, more particularly to a method for manufacturing chip antenna by utilizing a genetic algorithm to encode possible configurations of a metallic wire attached thereon into a plurality of codes as their chromosomes for mating with each other to produce offspring, and utilizing a simulation tool to evaluate the properties of the chromosomes and find the superior chromosomes corresponding to the configurations of metallic wire for manufacturing a chip antenna having superior physic performances.

(2) Prior Art

Wireless communication plays a very important role in the current and future global communication environments. Most of the communication device manufacturers have devoted a lot of efforts on developing wireless communication devices having the ability of successfully communicating in a good quality without being influenced by the environments of locations. On the other hand, since the wireless communication has the ability of transmitting and receiving signals between remote areas, a variety of valued communication services are therefor booming in the recent years. No matter the communication services belong to data transmission, video transmission or audio transmission services, the providers thereof are all intended to utilize the high speed and powerful wireless transmission platform to expand their businesses and benefit the consumers. Therefore, how to develop a wireless communication device to achieve the above requirements and manufacture a wireless communication device remaining slim, compact and user friendly after the above requirements being achieved, is now a very important object for the communication device manufactures.

In recent years, the wireless communication systems, such as cellular phones, have been used widely, the mechanisms and the components of semiconductors installed therein have already been designed to meet the possible miniaturizing demand Even the batteries installed on the cellular phones are also designed by using polymeric materials to effectively reduce their volumes into a slim and compact size. In additional, since the antenna radiation patterns for portable communication devices are desired to have omni-directional radiation pattern, the monopole antenna is thus installed in portable communication devices due to its omni-directional radiation pattern in a horizontal plane. However, the monopole antenna is gradually replaced by resonator antenna (DR antenna) or chip antenna due to the coaxial cables and connectors connected to the monopole antenna will increase the total packaging cost and volume. The chip antenna also have omni-directional radiation pattern, and can be made with small size and be mounted directly on the printed circuit boards (PCB) in the communication devices by using surface-mount-technology (SMT), which not only significantly reduce space occupied by the antenna, but also reduce the assembling cost therefor. Furthermore, the chip antenna can be combined with the circuit board and be hidden in the mechanism to save space for installing other useful mechanisms or circuits to expand its functions and performances. However, there will incur some problems in impedance matching, bandwidth and radiation efficiency while reducing the size of antenna.

The chip antenna 10 currently used in a variety of electronic devices is shown as FIGS. 1 and 2. This kind of chip antenna 10 comprises a substrate 11 made of dielectric material having high dielectric constant $\epsilon$, i.e. the dielectric material with the dielectric constant $\epsilon$ within the range of 1~130. The most popular dielectric material is the ceramic material of a square or rectangular shape. There are some metallic wires 12 on the top surface of the substrate 11, which are formed by utilizing both photolithography and etching technologies, and then, by utilizing sinter technology, sintered with the ceramic substrate 11. A metallic ground plane 13 is attached on the bottom surface. A coaxial cable 14 having a top feeding pin 141, which penetrates through the ground plane 13 and substrate 11 to contact with the feeding point 121 of the metallic wires 12, and an outer conductor 142, which is in contact with the ground plane 13. Thus, a module of chip antenna 10 is completed and able to receive signals through the metallic wires 12 and transmit the same to the communication device via the feeding pin 141.

In the procedures of manufacturing the conventional chip antenna, the sinter technology necessary for sintering the metallic wires 12 together with ceramic substrate 11 not only will incur very high expenses therefor, but also unable to accurately control the properties of impedance matching, bandwidth and radiation efficiency of the antenna. Therefore, how to quickly and accurately manufacture chip antenna with low cost and high performances is the main topic needs to be solved now.

SUMMARY OF THE INVENTION

With respect to the disadvantages of expensive and complicate procedures for manufacturing the conventional chip antenna, the inventor has done a long term efforts in research and experiment, and developed a method for manufacturing an antenna by utilizing a genetic algorithm in order to design an antenna having superior performances. The method not only can effectively simplify the manufacturing procedures, but also can significantly reduce the costs and facilities needed in the procedures, low down the production cost, and miniaturize the volume of antenna.

Therefore, an object of the present invention is to provide a method for manufacturing chip antenna by utilizing a genetic algorithm to encode possible configurations of metallic wire attached thereon into a plurality of codes as their chromosomes for mating with each to produce offspring, and utilizing a simulation tool to evaluate the properties of the chromosomes and find the superior chromosomes corresponding to the configurations of metallic wire for manufacturing a chip antenna having superior physic performances.

Another object of the present invention is to provide a method for manufacturing chip antenna by utilizing conventional cutting machines to cut a ceramic plate and a metallic film respectively, according to the configurations obtained through the genetic algorithm, to get a substrate and a metallic wire of the appropriate configurations, and then attaching the metallic wire directly to the substrate to form a chip antenna. Since the procedures for manufacturing the chip antenna can be completed easily and quickly by using conventional cutting machines, and the expensive and complicate sintering procedures and facilities is no more needed, it thus significantly reduce the production cost of the antenna.

The above and other objects, features and advantages of the present invention will become apparent from the following detailed description taken with the accompanying drawings.

BRIEF DESCRIPTION OF THE TABLES

TABLE 1 shows fitness values tested and calculated by using an electromagnetic simulation tool, namely "FIDELITY" issued by Zeland software company, with respect to the configurations of the 16 first generation chromosomes G1-1~G1-16 being collected in one preferred embodiment of the present invention;

TABLE 2 shows a ranking list of the chromosomes listed in TABLE 1 by their fitness values;

TABLE 3 shows three sets of superior chromosomes obtained after repeating the mating and ranking processes six times with respect to the chromosomes listed in TABLE 1;

TABLE 4 shows the data of resonant frequency, return loss and Smith Chart measured from the experiments to the antennas corresponding to three sets of superior chromosomes;

TABLE 5 shows the data of radiation pattern measured from the experiments to the antennas corresponding to three sets of superior chromosomes.

DETAILED DESCRIPTION OF THE PREFERRED EMBODIMENTS

Figure 1:
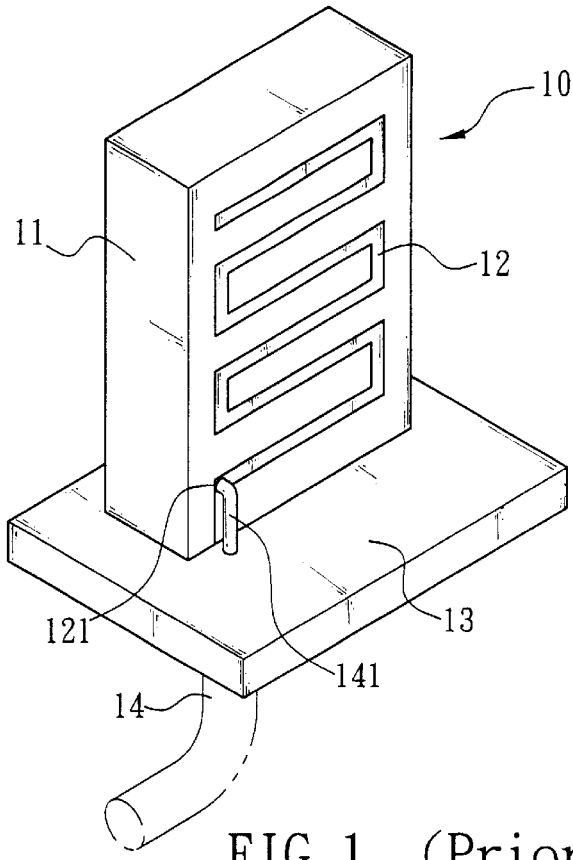
FIG. 1 (Prior Art)
FIG. 1 is a perspective view showing a conventional antenna module.
Figure 2:
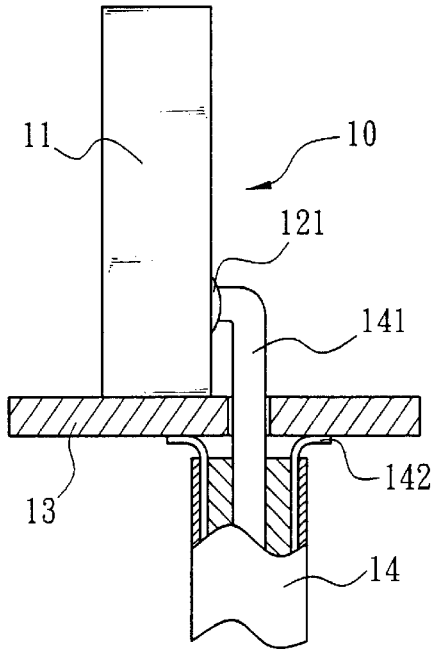
FIG. 2 (Prior Art)
FIG. 2 is a side view of a conventional antenna module.
Figure 3:
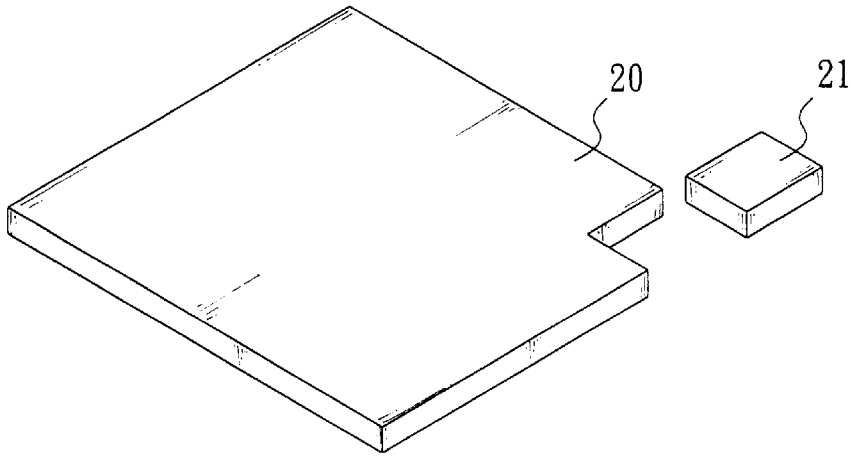
FIG. 3 is a perspective view showing a substrate of the present invention being cut by a conventional cutting machine from a ceramic.
Figure 4:
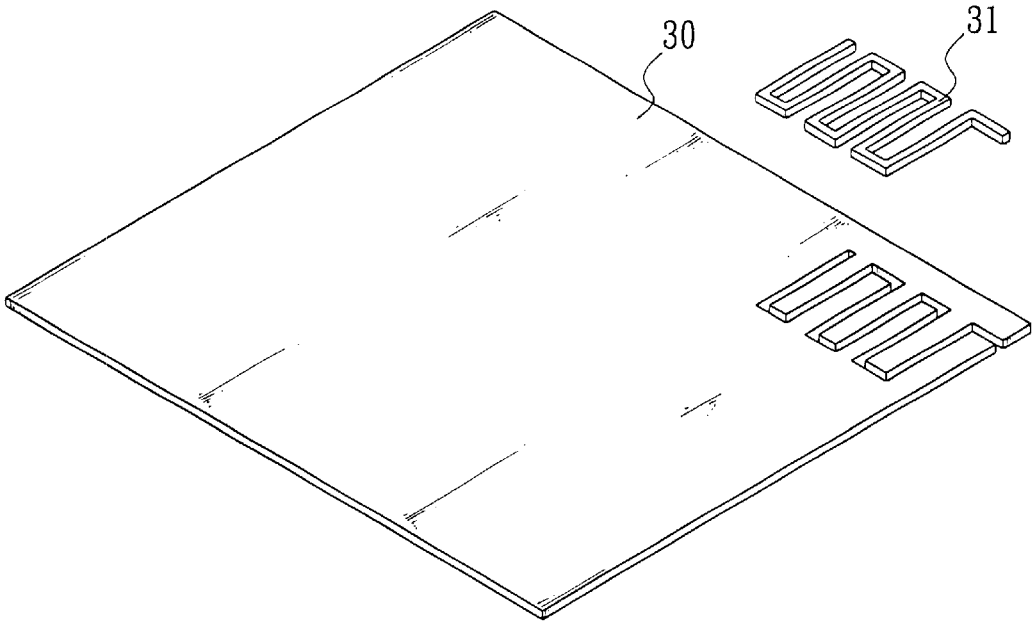
FIG. 4 is a perspective view showing a metallic wire of rampart shape of the present invention being cut by a conventional cutting machine from a metallic firm.
Figure 5:
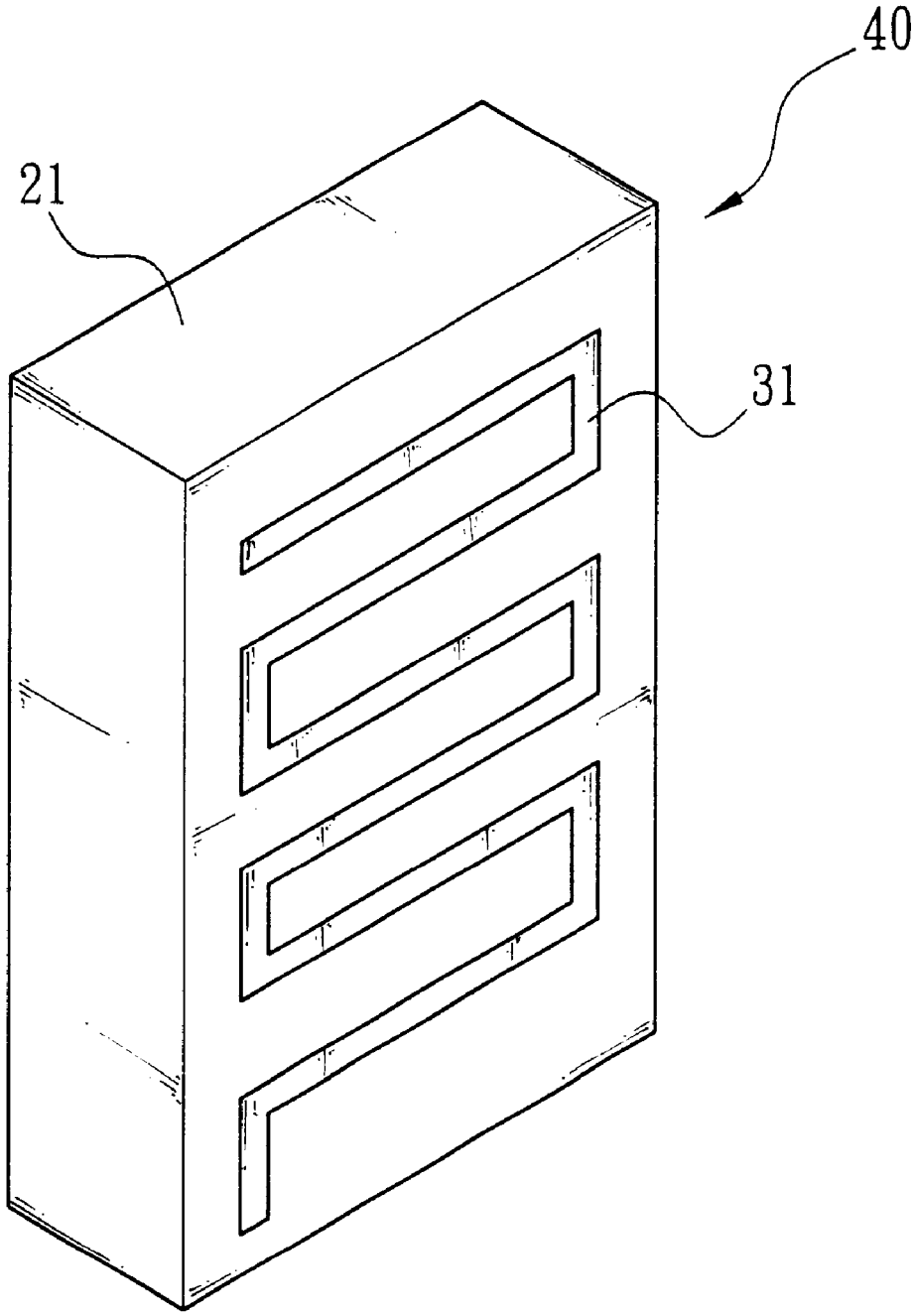
FIG. 5 is a perspective view showing a chip antenna of the present invention while the metallic wire being attached to the substrate.

The present invention is a method for manufacturing a chip antenna by utilizing a genetic algorithm. Referring to FIGS. 3 and 4, the method utilizes conventional cutting machines to cut a ceramic plate 20 and a metallic film 30 respectively to obtain a substrate 21 and a metallic wire 31 of appropriate shapes for manufacturing the chip antenna. Then, by attaching the metallic wire 31 to the substrate 21 to form a chip antenna as shown in FIGS. 5.

In one preferred embodiment of the present invention, a diamond-cutting machine is used to cut a ceramic plate 20 into a plurality of square or rectangular shaped substrates 21 of the necessary specification. A wire-cutting machine is used to cut a metallic film 30 into a plurality of wires 21 in accordance with the configuration calculated by the genetic algorithm. In the preferred embodiment of the present invention, it only needs to attach the metallic wire 31 directly to the substrate 21 to complete the manufacture of the chip antenna in an easy and quick way.

Figure 6:
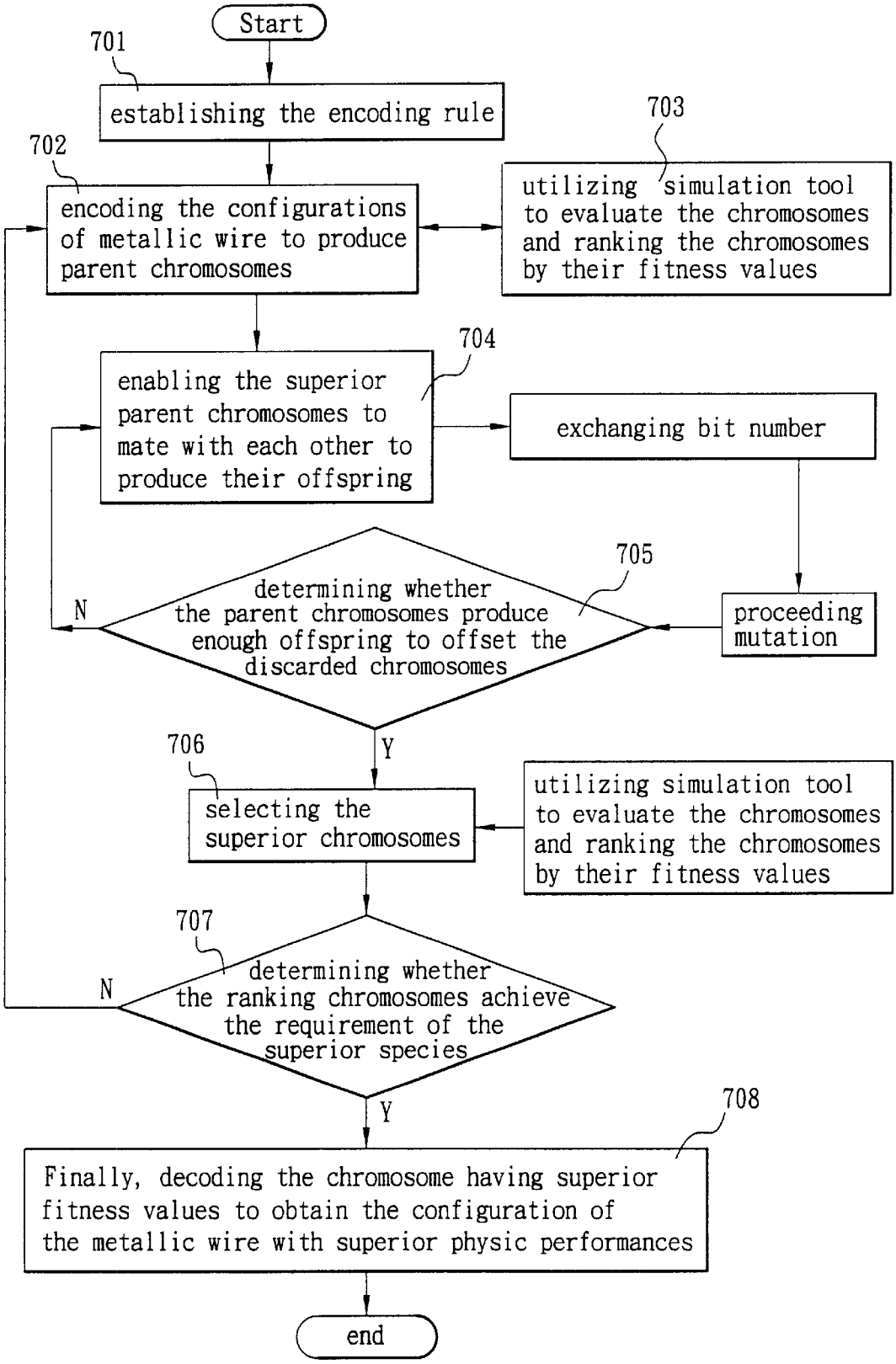
FIG. 6 is a flow chart showing the procedures of finding the superior configurations of metallic wire for manufacturing chip antenna by utilizing a genetic algorithm.
Figure 7:
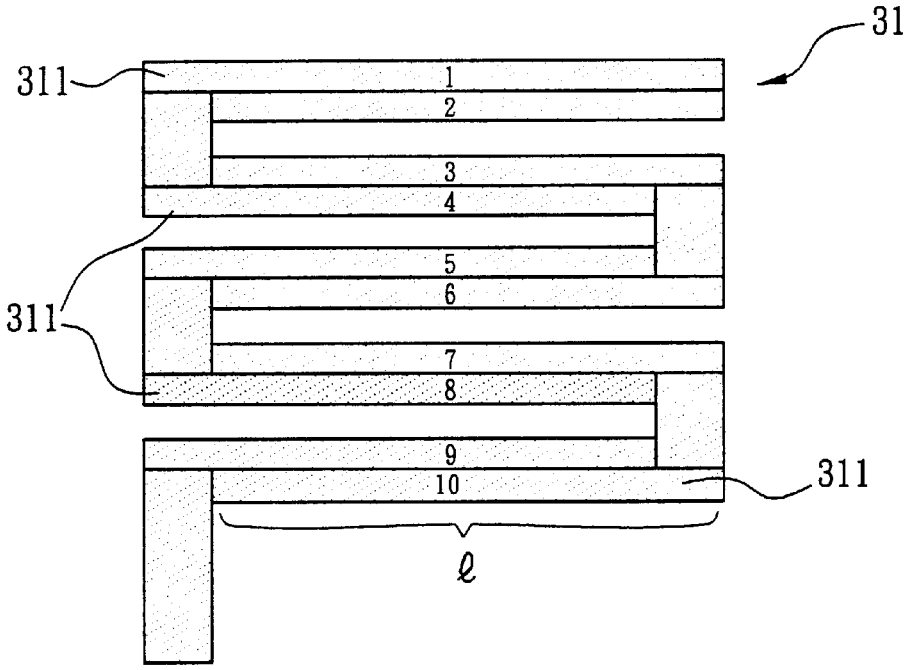
FIG. 7 is a top view showing a metallic wire of rampart shape of the present invention being defined thereon a plurality of blocks.

According to the present invention, referring to FIG. 6, the process of the genetic algorithm comprises the steps as follows:

(701) First, scheming a plurality of blocks 311 on the metallic film 30 according to the properties of the chip antenna required, referring to FIG. 7. Each block is represented by a bit number to show whether it is selected (for example, 1 represents being selected and 0 represents not being selected). Therefore, after these blocks being selected, the bit numbers will be combined sequentially to form a corresponding number, which is encoded as a binary to represent the configuration of a metallic wire 31. The binary is then defined as a chromosome of the chip antenna corresponding to the configuration of the metallic wire 31.

(702) Arbitrarily selecting the blocks to form the possible configurations of the metallic wire 31, and collecting a certain quantity of configurations of the metallic wire 31 and the associated chromosomes;

(703) Utilizing an electromagnetic simulation tool to evaluate the configurations of the metallic wires 31 corresponding to their chromosomes and calculate their fitness values, ranking the chromosomes from the best to the worst by their fitness values respectively, and discarding the chromosomes having poor fitness values and leaving the superior species-subset remained on the original ranking list as parent chromosomes.

(704) According to the gene evolution theory, every chromosome inherits some kinds of superior characteristics from their parents, therefore, while two species mates with each other to produce their offspring, the chromosome of their offspring will inherit the superior characteristics from their parent's chromosomes. Thus, enabling the parent chromosomes to mate with each other to produce their offspring respectively;

(705) Determining whether the parent chromosomes produce enough offspring to offset the discarded chromosomes and to let the total number of chromosomes be the same as the original; if yes, going to Step (706); otherwise, going to Step (704), keeping on mating to produce offspring.

(706) Utilizing the simulation tool to evaluate the chromosomes of the offspring and calculate their fitness values, adding the fitness values of the offspring into the previous ranking list, and ranking the chromosomes in the list by fitness values.

(707) Determining whether the ranking chromosomes achieve the requirement of the superior species; if yes, it means that a set of chromosomes having superior fitness values are produced, then going to Step (708); otherwise, going to Step (702), again proceeding with the processes of mating and ranking in order to discard the chromosomes having poor fitness values until producing at least one set of chromosome having superior fitness values.

(708) Finally, decoding the chromosome having superior fitness values to obtain the configuration of the metallic wire with superior physic performances.

Thus, according to the configuration obtained in the above steps, cut the metallic wire from the metallic film by using the wire cutting machine.

Figure 8:
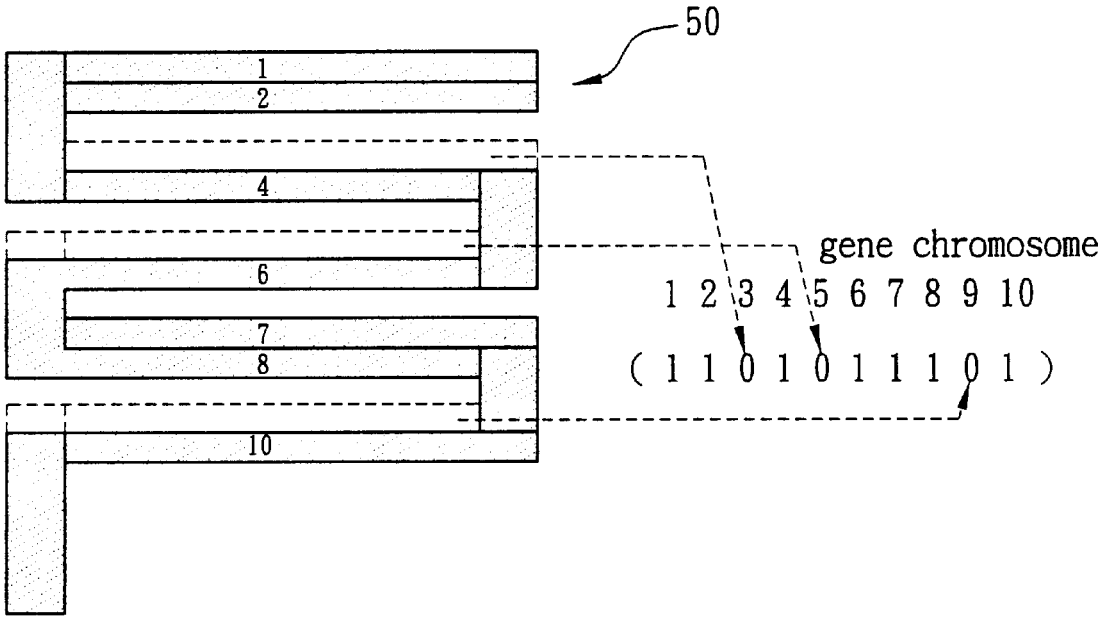
FIG. 8 is a top view showing a metallic wire of the present invention being collected after selecting the blocks thereon.

In the preferred embodiment of the present invention, the metallic wire 31 is designed to be attached to a ceramic substrate of the size, i.e. length 11 mm, width 10.5 mm and thickness 2 mm. The configuration of the metallic wire 31 is designed in a rampart shape, as shown in FIG. 7. Since the longer segments l in the metallic wire 31 have great influence on the radiation pattern, the preferred embodiment only selects the longer segments l to define the blocks, and schemes each of the segment into two blocks 311. Thus, the rampart shaped metallic wire 31 is schemed into ten blocks 311. Each of the blocks is given a bit number "1" or "0", of which "1" represents being selected and "0" represents not being selected, to encode the possible configurations of the metallic wire 31. According to the above encoding rule, after arbitrarily selecting the blocks to produce possible configurations of the metallic wire 31, a plurality of binaries are obtained respectively by encoding the bit numbers corresponding to the blocks of configurations. Each binary represents one chromosome corresponding to one configuration of the metallic wire 31. As referring to FIG. 8, the configuration of a metallic wire 31 is obtained after arbitrarily selecting the blocks, wherein the blocks 3, 5 and 9 corresponding to the bit number "0" represent not being selected, the rest blocks corresponding to the bit number "1" represent being selected. After one configuration of the metallic wire is encoded, the metallic wire 31 is represented by a chromosome of the matrix value [110101101]. According to the aforesaid encoding rule, after 16 first generation chromosomes G1-1~G1-16, as shown in Table 1, being collected, the preferred embodiment utilizes an electromagnetic simulation tool, namely "FIDELITY" issued by Zeland software company, to test the configuration corresponding to each of the chromosomes and calculate the fitness values thereof respectively as shown in Table 2. The fitness values represent the return loss |s11| (in the unit of dB) of the metallic wire 31 corresponding to the chromosome. It is very important to note that, since the metallic wire 31 is in rampart shape, while the blocks are selected or unselected to define a chromosome for each possible configuration of the metallic wire 31, any chromosome causing the metallic wire 31 broken and discontinued should be voided. The matrix values of such void chromosomes are [0011111111], [1100111111] and [1111001111] . . . etc., it means that the chromosomes corresponding to the blocks 1 and 2, or 3 and 4, or 5 and 6 not being selected should be deemed to be void.

Figure 9:
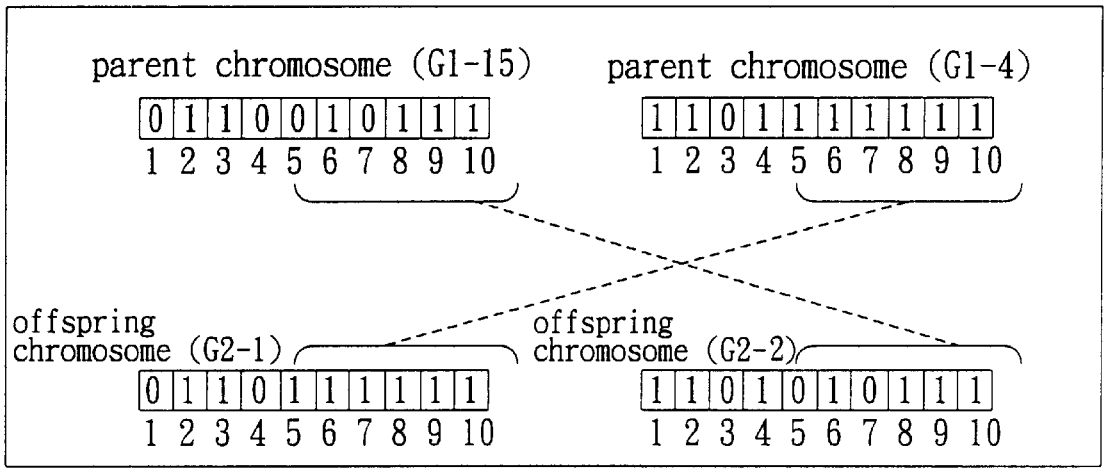
FIG. 9 shows the mating between two parent chromosomes to produce their offspring.
Figure 10:
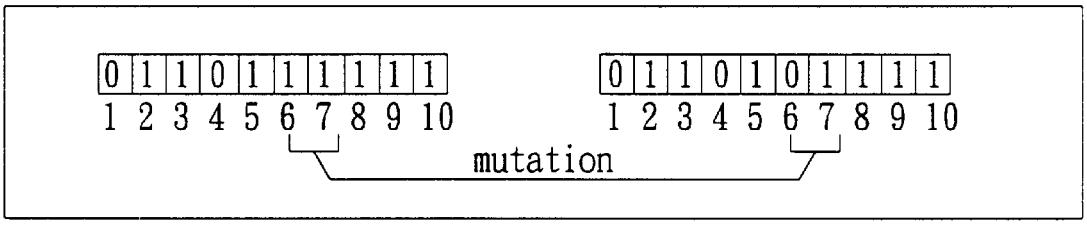
FIG. 10 shows the mutation of one chromosome of the offspring produced in FIG. 9.

The preferred embodiment is then to rank the chromosomes by their fitness values from best to worst, and select the first 8 high ranking chromosomes and discard the rest 8 low ranking chromosomes. The first 8 high ranking chromosomes being selected are defined as parent chromosomes, which are paired randomly to mate with each other. As referring to FIG. 9, the parent chromosomes G1-15 and G1-4 mates with each other to produce their offspring G2-1 and G2-2 by exchanging the bit numbers in the parent chromosomes. The mutations of their offspring are produced merely by changing parts of the bit numbers in the chromosomes thereof from 0 to 1, or from 1 to 0. Again, the preferred embodiment utilizes the simulation tool "FIDELITY" to test the chromosomes of the offspring and calculate their fitness values, then adds the fitness values of the offspring into the previous left 8 high ranking chromosomes for ranking, and selects the first 8 high ranking chromosomes and discards the rest 8 low ranking chromosomes. Repeating the above steps, those chromosomes having lower fitness values will eventually be discarded and, after a plurality of mating and selecting processes, at least one set of superior chromosomes will be obtained while all of the chromosomes and the associated fitness values become the same in the processes.

Figure 11:
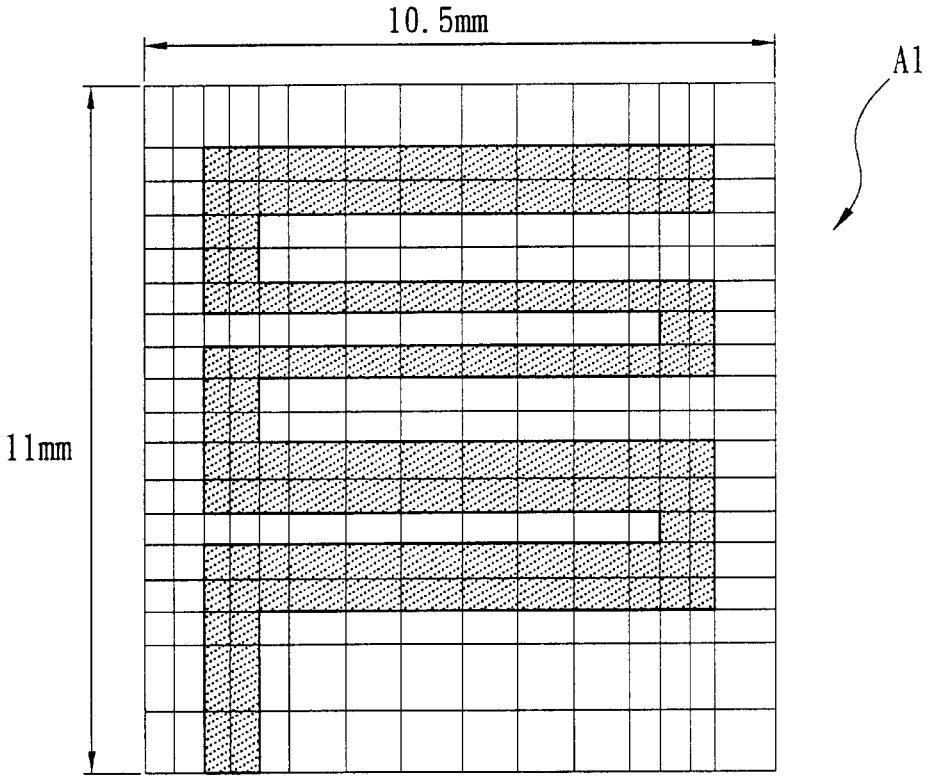
FIG. 11 is a top view showing a chip antenna A1 obtained from one preferred embodiment of the present invention with the metallic wire having the superior chromosome.
Figure 12:
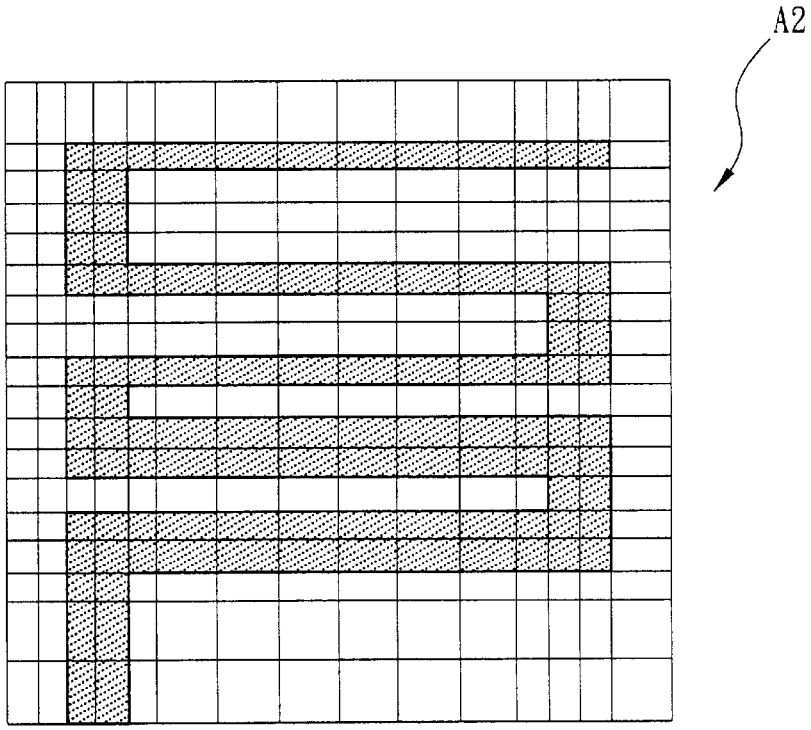
FIG. 12 is a top view showing another chip antenna A2 obtained from the preferred embodiment of the present invention with the metallic wire having the superior chromosome.
Figure 13:
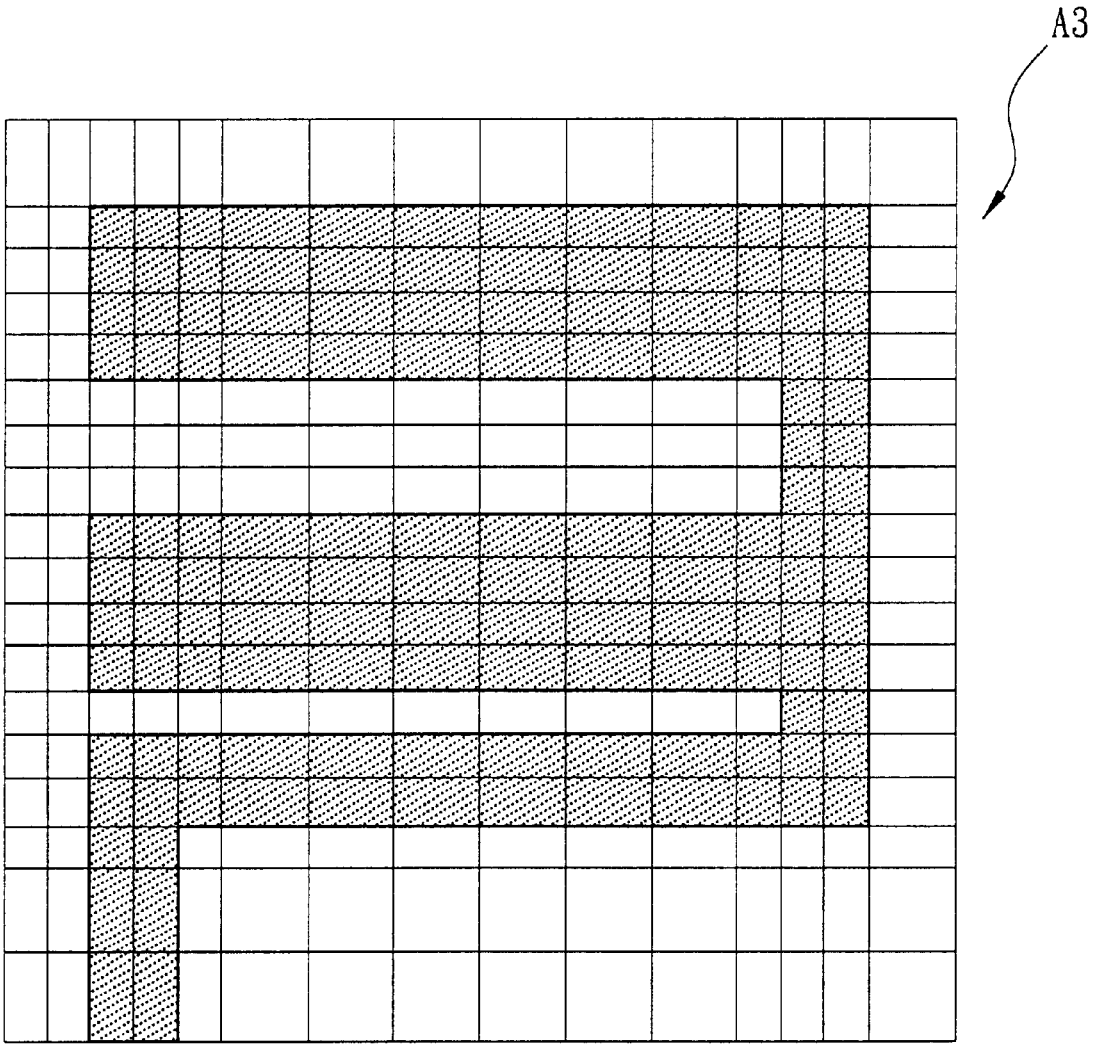
FIG. 13 is a top view showing another chip antenna A3 obtained from the preferred embodiment of the present invention with the metallic wire having the superior chromosome.
Figure 14:
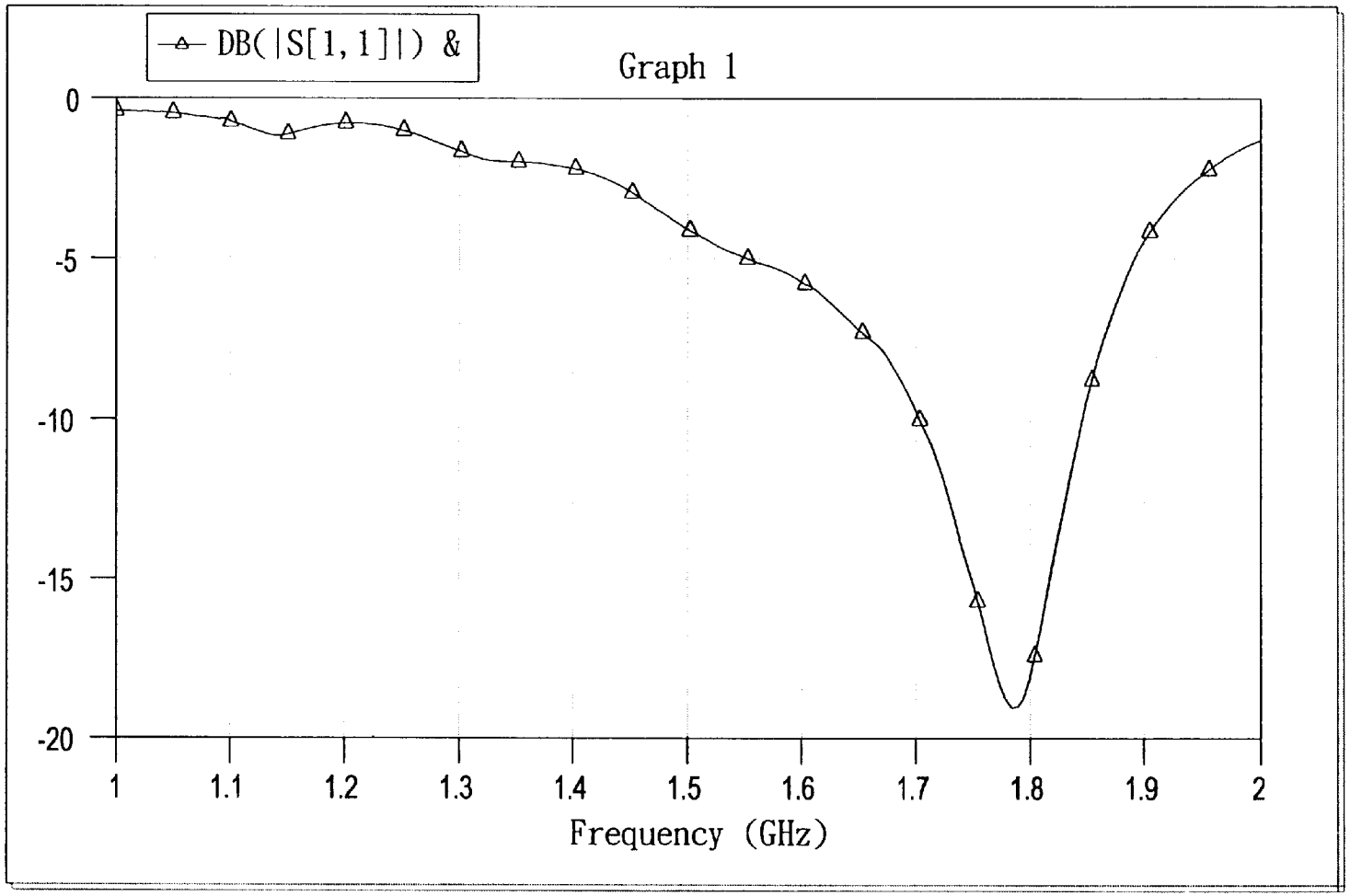
FIG. 14 shows the return loss |s11| of the chip antenna A1 shown in FIG. 11, n which the return loss |s11| is −19.0688 dB while resonant frequency occurs at 1.79 GHz.
Figure 15:
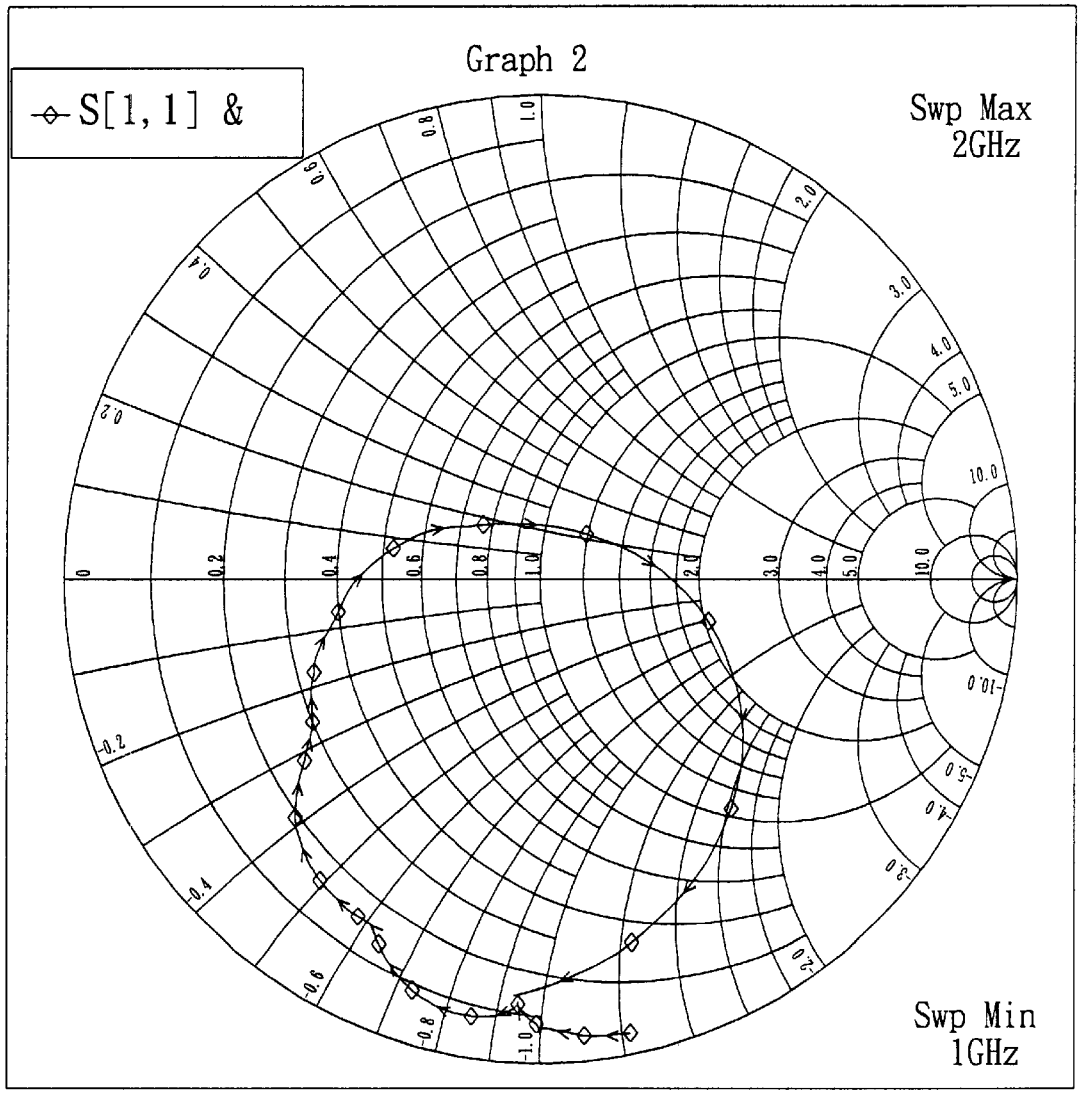
FIG. 15 shows the Smith Chart of the chip antenna A1 shown in FIG. 11.
Figure 16:
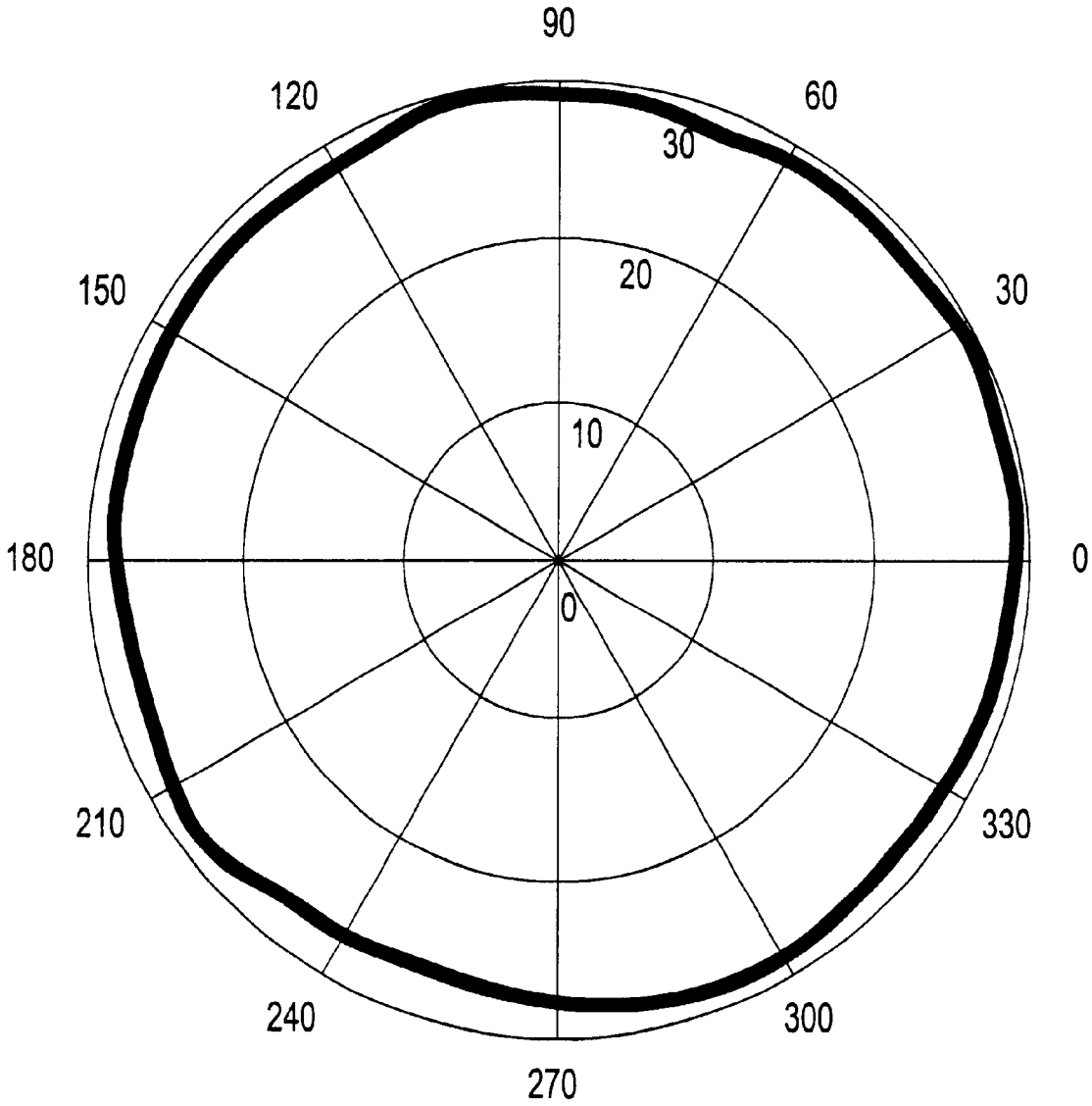
FIG. 16 shows the radiation pattern of Ey of the antenna A1 shown in FIG. 11.
Figure 17:
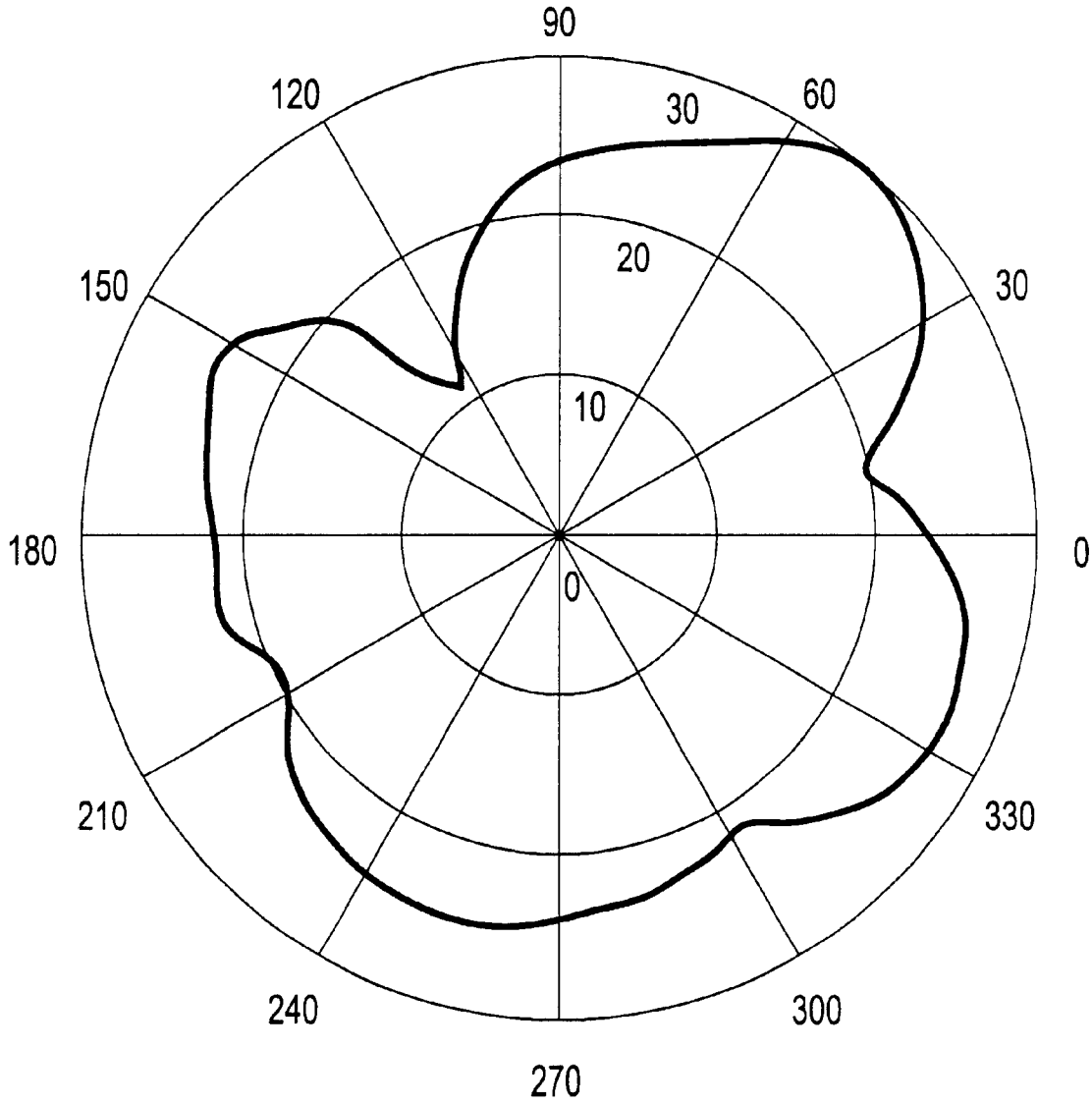
FIG. 17 shows the radiation pattern of Ex of the antenna A1 shown in FIG. 11.
Figure 18:
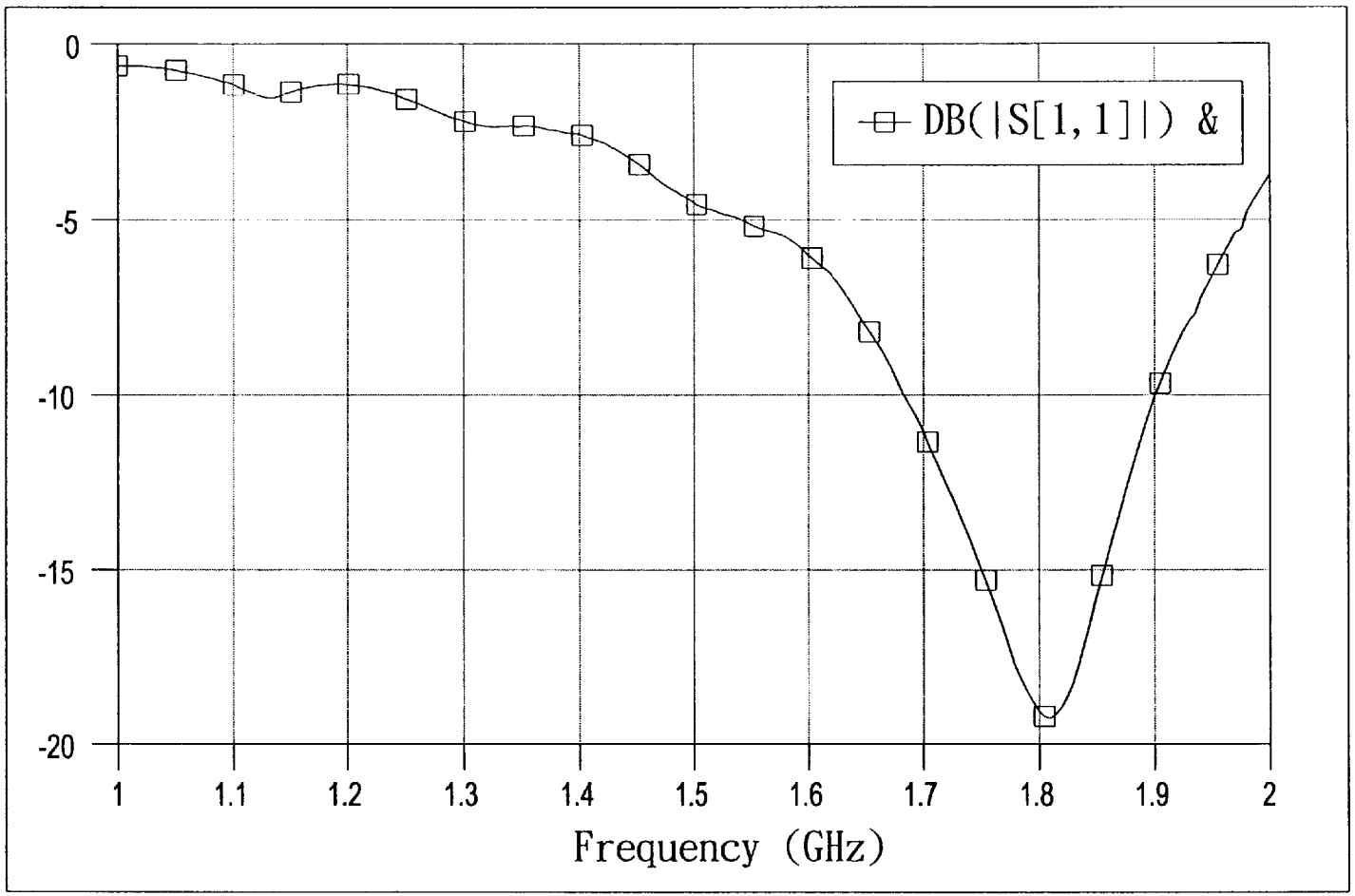
FIG. 18 shows the return loss |s11| of the chip antenna A2 shown in FIG. 12, in which the return loss |s11| is −19.3226 dB while resonant frequency occurs at 1.8074 GHz.
Figure 19:
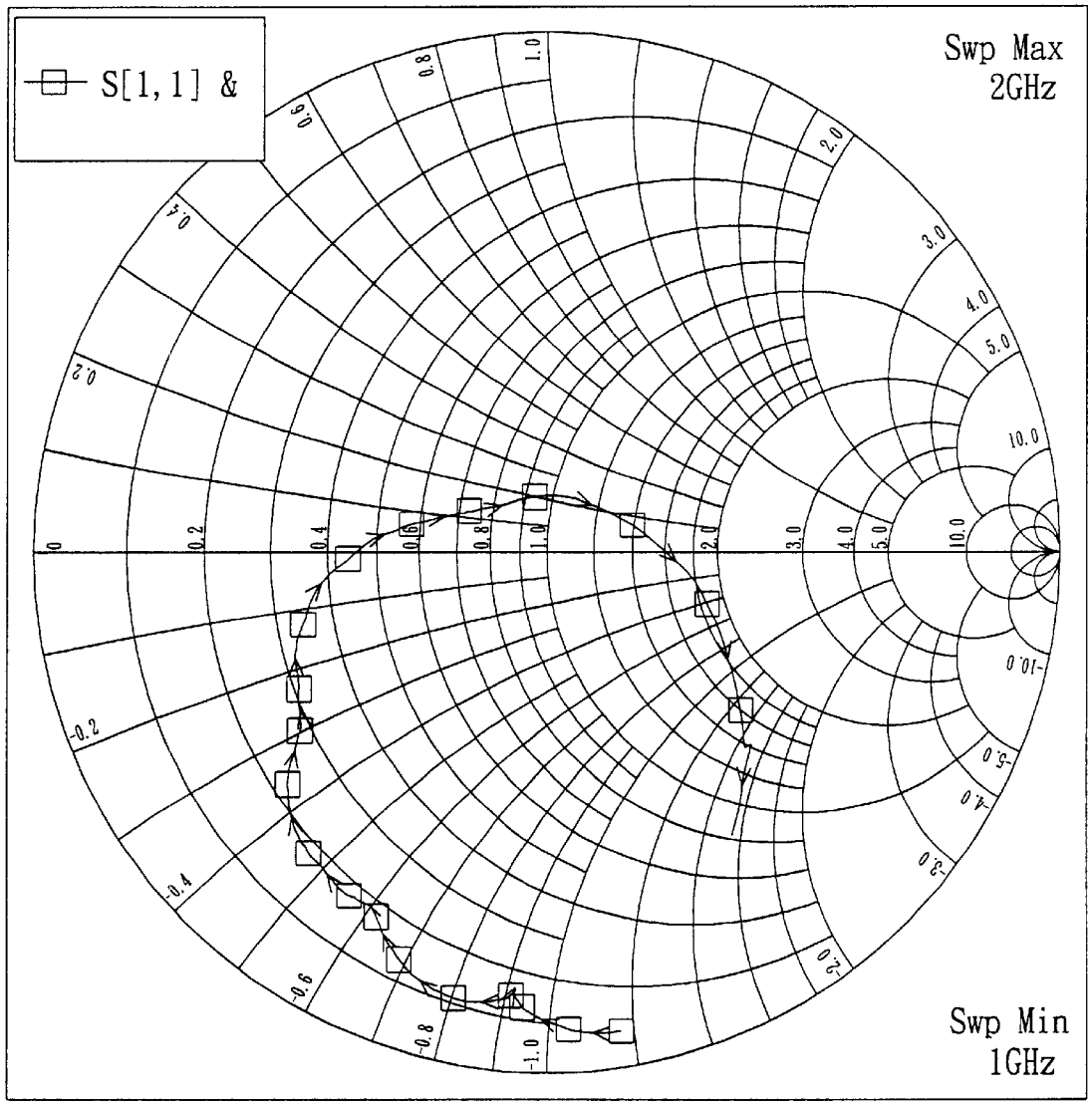
FIG. 19 shows the Smith Chart of the chip antenna A2 shown in FIG. 12.
Figure 20:
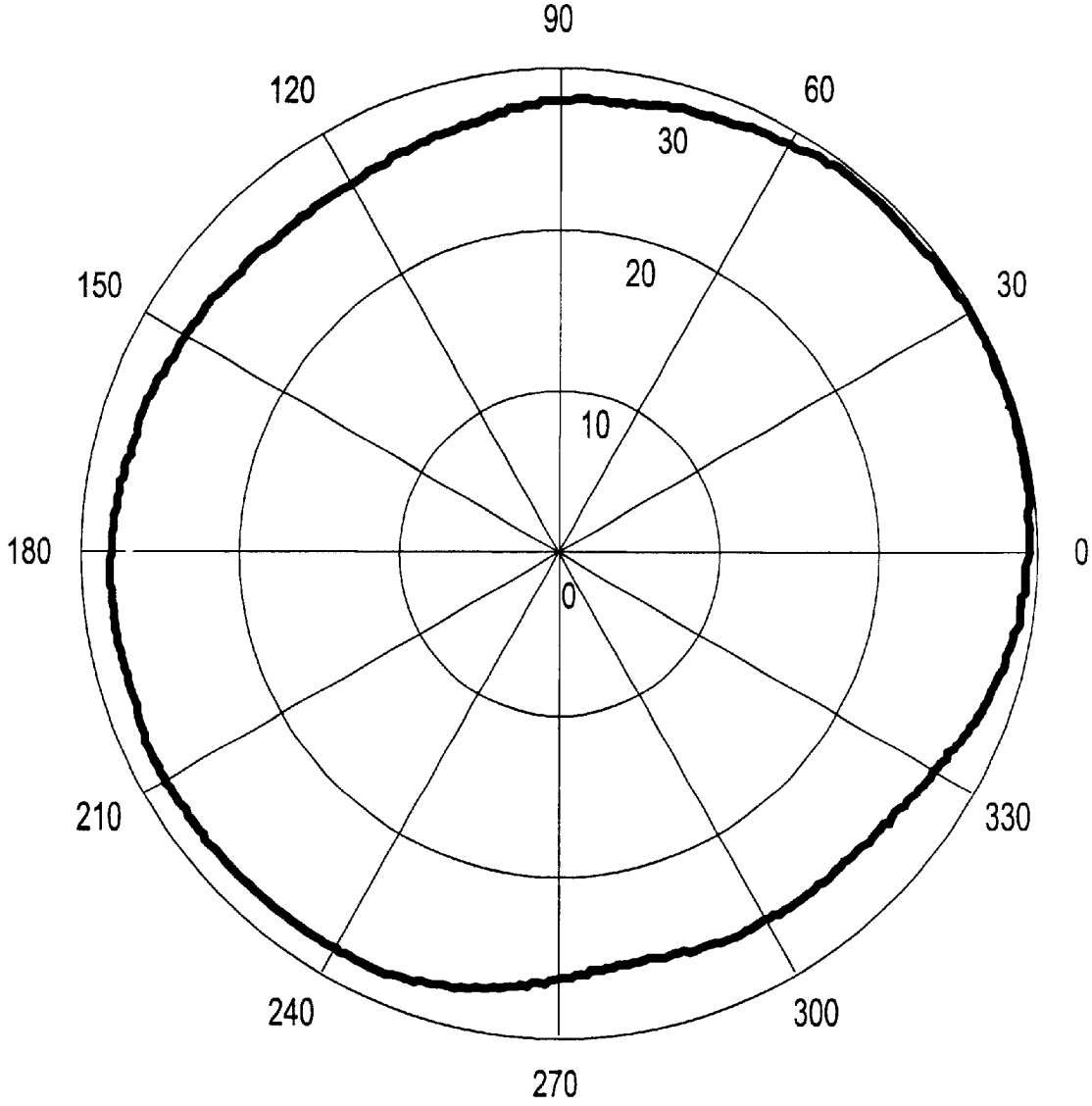
FIG. 20 shows the radiation pattern of Ey of the antenna A2 shown in FIG. 12.
Figure 21:
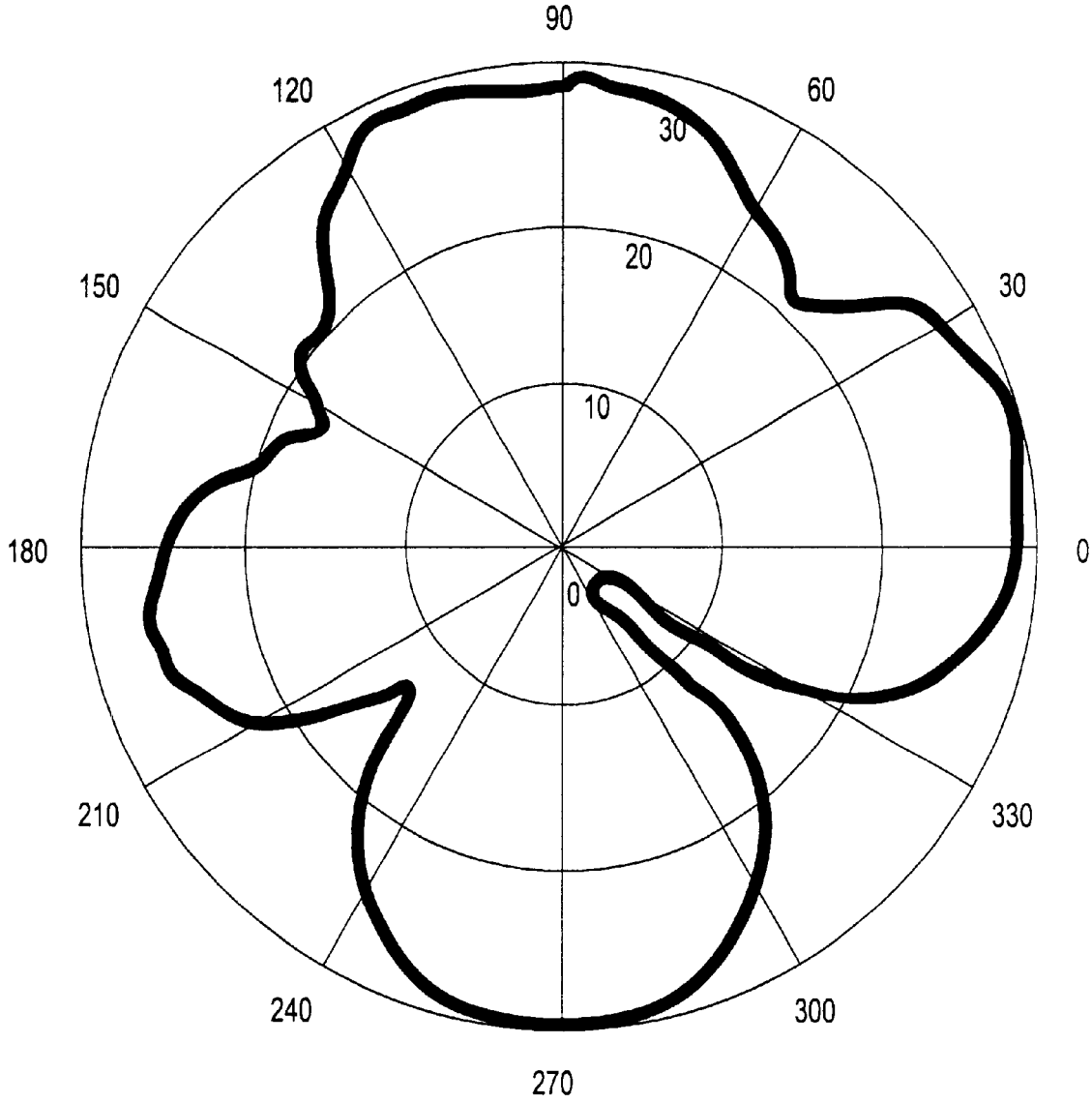
FIG. 21 shows the radiation pattern of Ex of the antenna A2 shown in FIG. 12.
Figure 22:
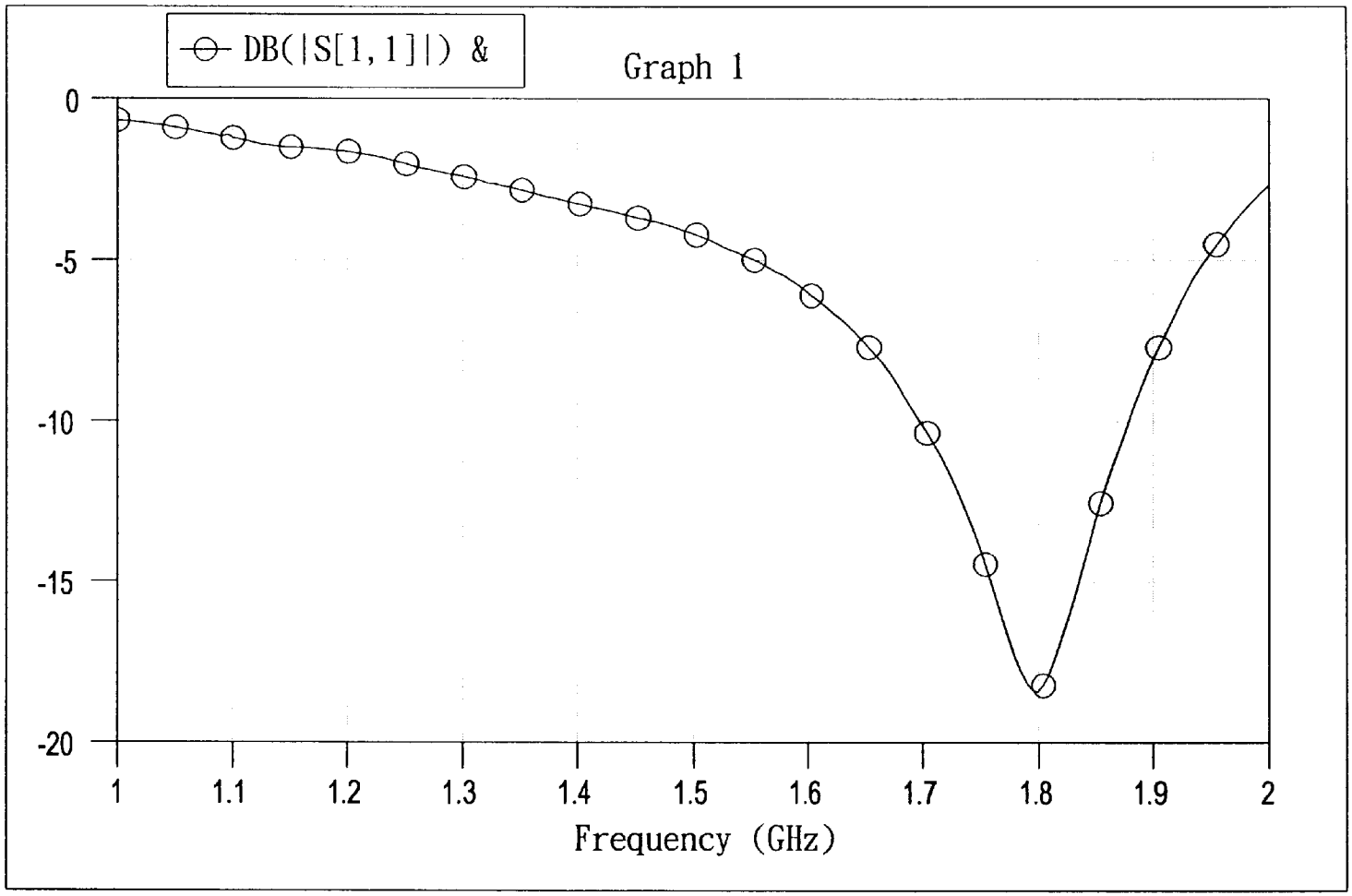
FIG. 22 shows the return loss |s11| of the chip antenna A3 shown in FIG. 13, in which the return loss |s11| is −18.44726 dB while resonant frequency occurs at 1.7975 GHz.
Figure 23:
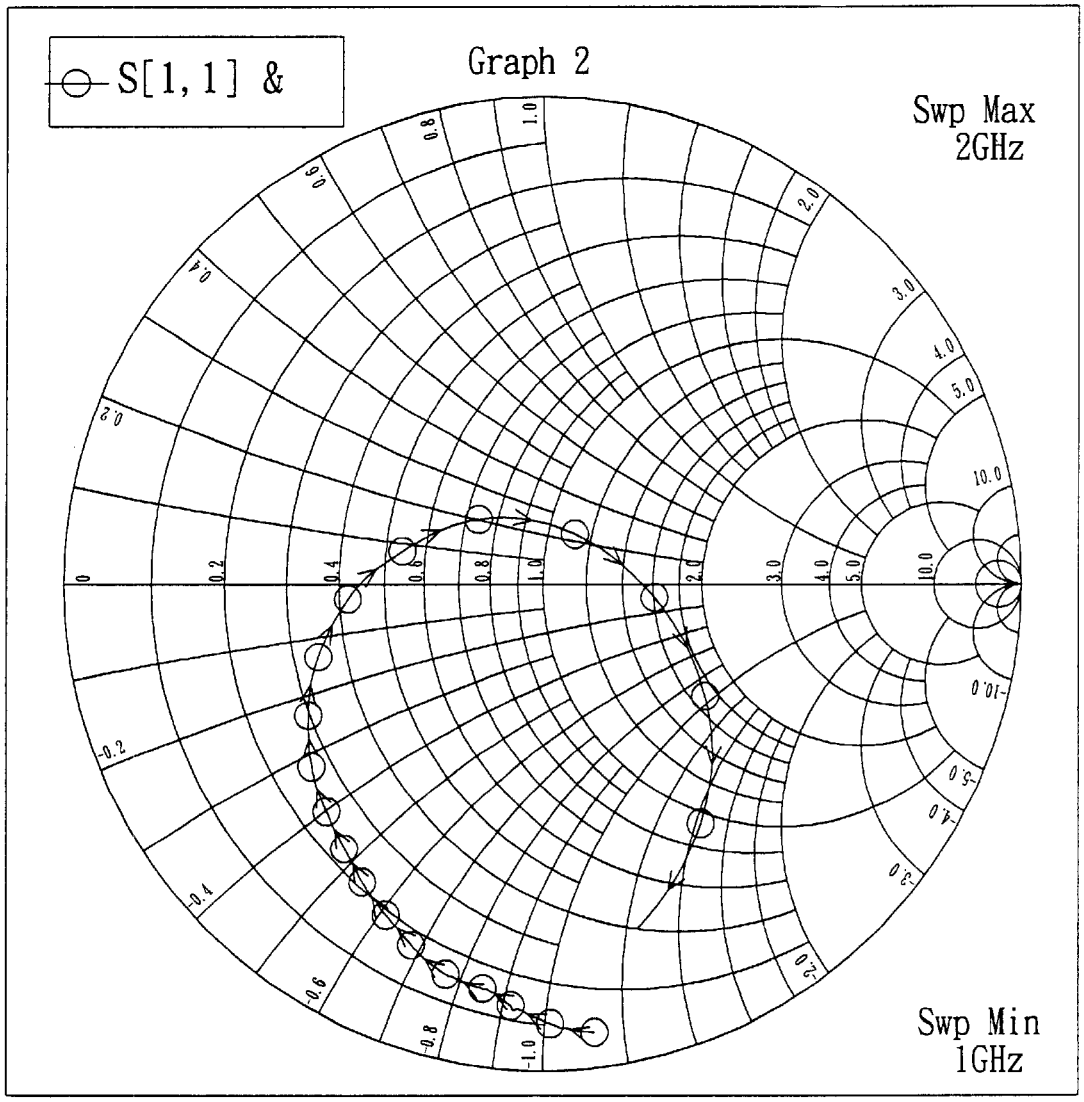
FIG. 23 shows the Smith Chart of the chip antenna A3 shown in FIG. 13.
Figure 24:
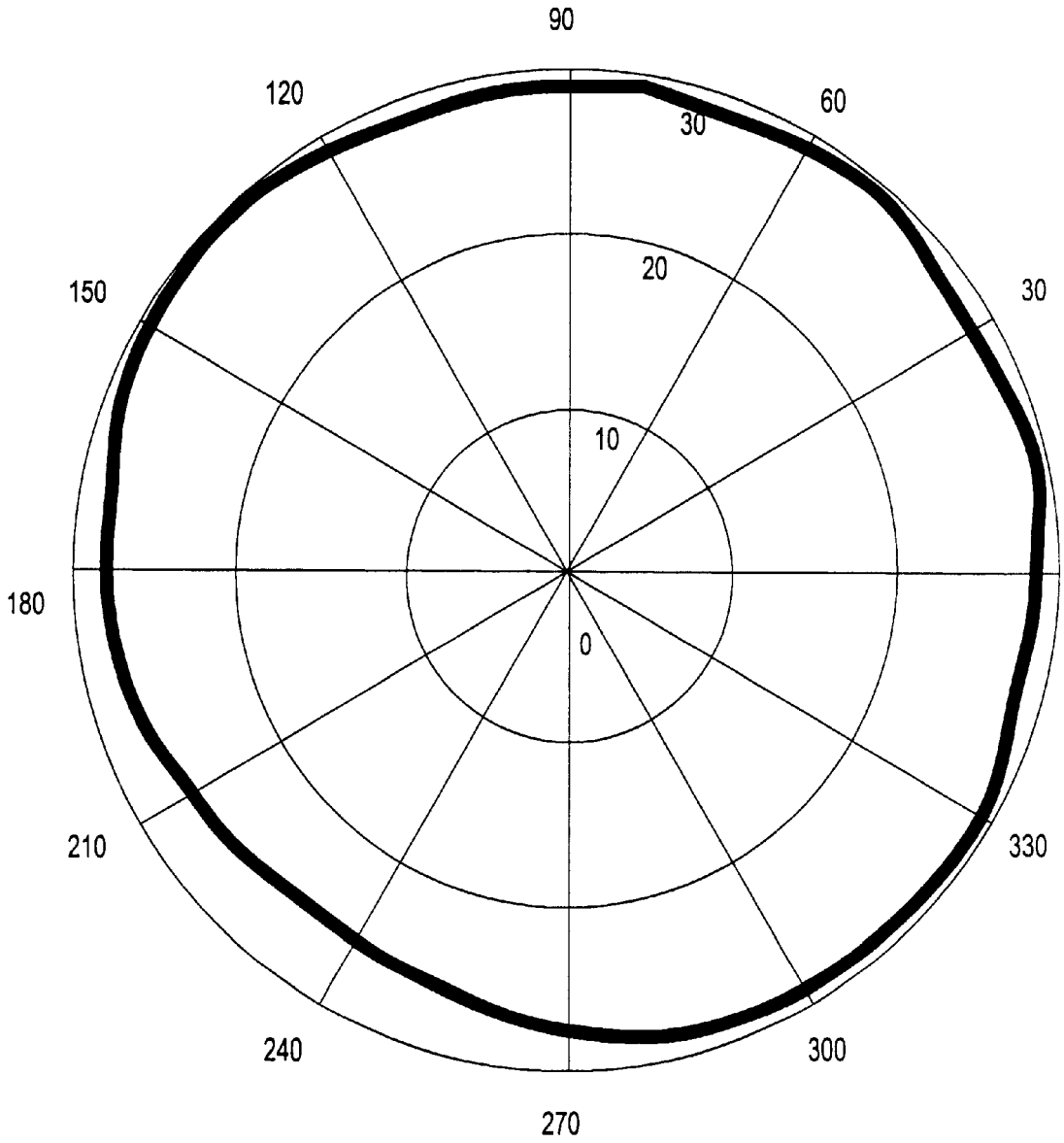
FIG. 24 shows the radiation pattern of Ey of the antenna A3 shown in FIG. 13.
Figure 25:
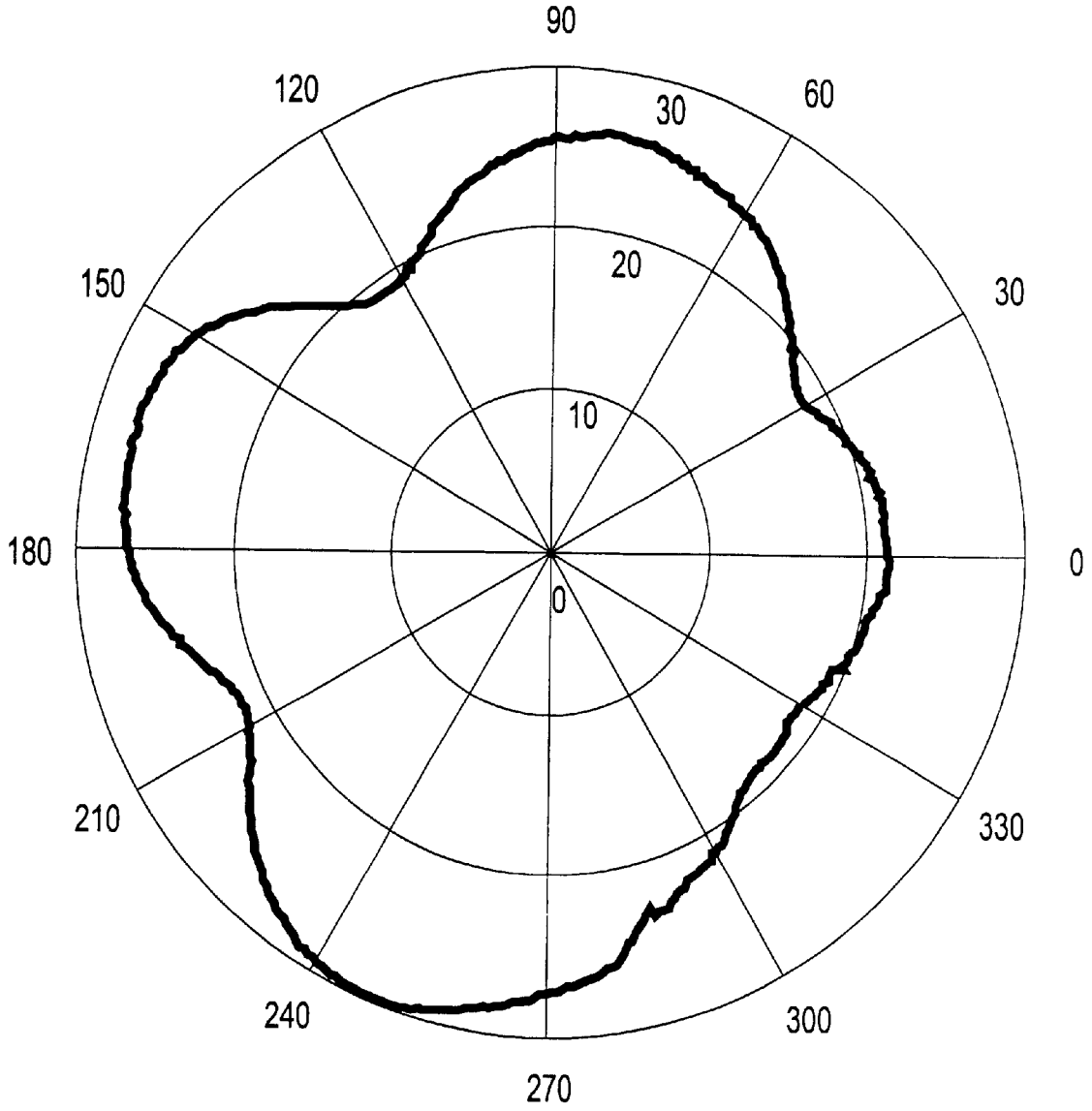
FIG. 25 shows the radiation pattern of Ex of the antenna A3 shown in FIG. 13.

In the preferred embodiment of the present invention, after repeating the above processes six times, three sets of superior chromosomes are obtained, i.e. [1101101111], [1001011111] and [1110011111], along with the fitness values as shown in Table 3. Thus, after decoding the three sets of the chromosomes, the corresponding configurations of the metallic wire having superior physic performances will then be obtained. Thus, as shown in FIGS. 11, 12 and 13, the metallic wires is cut from the.metallic film according to the configurations obtained by using the wire cutting machine. Then, it only needs to attach the metallic wire 31 directly to the substrate 21 to finish the manufacture of chip antenna of the present invention in an easy and quick way and form three chip antennas A1, A2 and A3.

In order to prove that the three chip antennas A1, A2 and A3 manufactured by the preferred embodiment have superior impedance matching and can be used in GSM personal mobile handset under operating at 1.8 GHz. The preferred embodiment also made experiments with respect to the three chip antennas A1, A2 and A3, wherein the distance between the transmitting antenna and receiving antenna (chip antenna) is 5 meters long. The data of resonant frequency, return loss, Smith Chart and radiation pattern for each antenna measured from the experiments are listed and shown on Table 4 and FIGS. 14~25. It shows that all of these antennas are omni-direction, and their bandwidth, as shown in Table 5, has significantly been improved.

While the invention has been described by means of specific embodiments, numerous modifications and variations could be made thereto by those skilled in the art without departing from the scope and spirit of the invention set forth in the claims.

What is claimed is:

1. A method for manufacturing chip antenna by utilizing a genetic algorithm, comprises the steps;

encoding possible configurations of a metallic wire, which are going to be attached onto a substrate to form a chip antenna, into a plurality of binaries as parent chromosomes of the different configurations of the metallic wire respectively;

enabling the parent chromosomes to mate with each other to produce offspring chromosomes;

utilizing simulation tool to test and calculate at least one property of the chromosomes;

ranking the chromosomes by the property from the best to the worst, and discarding the chromosomes having poor property and leaving the chromosomes having superior property remained on the original ranking list as parent chromosomes;

repeating the above steps until obtaining at least one set of chromosome having the superior property of a predetermined value;

decoding the set of chromosome to obtain the configuration of the metallic wire.

2. The method as claimed in claim 1, further comprises the step of cutting the substrate from a ceramic plate by using a cutting machine.

3. The method as claimed in claim 2, wherein the cutting machine is a diamond cutting machine.

4. The method as claimed in claim 1, further comprises the step of cutting the metallic wire from a metallic firm by using a cutting machine according the configuration being decoded.

5. The method as claimed in claim 4, further comprises the step of attaching the metallic wire to the substrate to form the chip antenna.

6. The method as claimed in claim 4, wherein the cutting machine is a wire cutting machine.

7. The method as claimed in claim 1, while encoding the possible configurations of the metallic wire further comprises the steps of:

scheming a plurality of blocks on the metallic film according to the properties of the chip antenna required, wherein each block is represented by a bit number to show whether being selected, and combining the bit numbers sequentially, after the corresponding blocks being arbitrarily selected, to form a binary representing a chromosome corresponding to one configuration of the metallic wire.

8. The method as claimed in claim 7, while arbitrarily selecting the blocks and collecting a certain quantity of different configurations of metallic wires and the associated chromosomes, further comprises the steps of:

utilizing an electromagnetic simulation tool to evaluate the configurations of the metallic wires corresponding to the chromosomes and calculate the fitness values thereof, ranking the chromosomes from the best to the worst by the fitness values respectively;

discarding the chromosomes having poor fitness values and leaving the chromosomes having the superior fitness values remained on the original ranking list as parent chromosomes.

9. The method as claimed in claim 8, further comprises the steps of:

enabling the parent chromosomes to mate with each other to produce enough offspring to offset the discarded chromosomes and to let the total number of chromosomes be the same as the original;

utilizing the simulation tool to evaluate the chromosomes of the offspring and calculate their fitness values;

adding the fitness values of the offspring into the previous ranking list and ranking the chromosomes in the list by the fitness values;

selecting the ranking chromosomes achieving the requirement of superior species;

repeating the above steps until discarding the chromosomes having poor fitness values and producing at least one set of chromosome having superior fitness values of a predetermined value.

10. The method as claimed in claim 9, while the blocks being selected or unselected to scheme the chromosome for each possible configuration of the metallic wire, further comprises the step of voiding any chromosome causing the metallic wire broken and discontinued.

11. The method as claimed in claim 9, wherein the fitness values represent the return loss |s11| in the unit of dB of the metallic wire corresponding to the chromosome.

12. The method as claimed in claim 9, while scheming the blocks on the metallic film further comprises the step of selecting a plurality of longer segments on the metallic wire and defining each segment as two blocks.

13. The method as claimed in claim 9, wherein the configuration of the metallic wire is defined in a rampart shape.

* * * * *